United States Patent [19]

Okumoto

[11] Patent Number: 4,899,491

[45] Date of Patent: Feb. 13, 1990

[54] SUN FILTER FOR A LOUVER PANEL

[76] Inventor: Gordon Okumoto, 853 Ilaniwai St., Honolulu, Hi. 96813

[21] Appl. No.: 180,961

[22] Filed: Apr. 13, 1988

[51] Int. Cl.[4] ..... E05B 7/02

[52] U.S. Cl. ..... 49/62; 160/236; 49/74; 350/263

[58] Field of Search ..... 49/61, 62, 74, 465; 160/178.1, 236, 166.1; 350/258, 263; 52/202, 203; 293/1

[56] References Cited

U.S. PATENT DOCUMENTS

| | | | |
|---|---|---|---|
| 2,046,601 | 7/1936 | Atkinson | 350/263 |
| 4,195,680 | 4/1980 | Hyman et al. | 160/166 A |
| 4,434,834 | 3/1984 | Ennes | 160/166.1 |

*Primary Examiner*—Kenneth J. Dorner
*Assistant Examiner*—Gerald A. Anderson
*Attorney, Agent, or Firm*—Bacon & Thomas

[57] ABSTRACT

A sun filter for a glass louver panel is disclosed which filters out the heat, glare and the ultraviolet rays which normally penetrate through the glass. The sun filter is formed of a resilient, plastic material such that it may be easily snapped over the existing louver panel without dismantling the panel from its support structure or in any way interfering with the normal operation of the louver panel. The filter has a resilient filter panel which bears against a face of the louver panel and frictional attaching legs which frictionally engage opposite edges of the louver panel to removably affix the sun filter to the panel.

15 Claims, 3 Drawing Sheets

SUN FILTER FOR A LOUVER PANEL

BACKGROUND OF THE INVENTION

The present invention relates to a sun filter, more particularly, a sun filter which is attachable to a louver panel of a jalousie window.

Jalousies have been found, over the years, to be an efficient way of providing light or ventilation to the interior of a building. Typically, such jalousie comprise a plurality of louver panels, constructed of metal, wood, or glass, and means to pivotally attach each of the louver panels to a window-type frame of the building. Actuating means interconnect all of the louver panels and enable them to be pivoted between a closed position, wherein the lower edges of the louver panels overlap an adjacent louver panel, to an open position to permit ventilation of the building.

When the jalousie is used as a window, the louver panels are made of transparent material, usually glass. The glass louver panels permit a substantial amount of the sun's heat, glare and ultraviolet rays to penetrate into the interior of the building even when in their closed positions.

It is known to provide protective panels which fit over the glass louver panels in order to prevent them from breaking during severe weather conditions. Typically, however, the panels are made of metal which necessitates their removal after the passage of the inclement weather conditions in order for the jalousie to resume its normal functions.

It is also known to make protective panels out of a corrugated, translucent plastic material and attach them to the louver panel by way of spring clips. However, this corrugated, translucent protective panel must also be removed from the glass louver panel if they are to achieve their full beneficial affects.

SUMMARY OF THE INVENTION

The present invention provides a sun filter for a louver panel, particularly a glass louver panel, which filters out the heat, glare and the ultraviolet rays which normally penetrate through the glass. The sun filter is formed of a resilient, plastic material such that it may be easily snapped over the existing louver panel without dismantling the panel from its support structure or in any way interfering with the normal operation of the jalousie. The filter has a resilient filter panel which bears against a face of the louver panel and frictional attaching legs which frictionally engage opposite edges of the louver panel to removably affix the sun filter to the panel.

The sun filter may be formed of transparent or translucent plastic and may be tinted in color to provide additional pleasing decorative effects. The easy removability of the sun filter enables the user to quickly and easily change the color of the jalousie windows to coordinate with either the exterior or the interior decor of the building.

By filtering out the ultraviolet rays along with the heat and glare of the sunlight passing through the louver panels, the sun filter enables such jalousie windows to provide adequate interior lighting, while at the same time minimizing the increase in the interior temperature due to the sunlight and the deterioration of interior furnishings due to the ultraviolet rays.

DETAILED DESCRIPTION OF THE PREFERRED EMBODIMENTS

Figure 1:
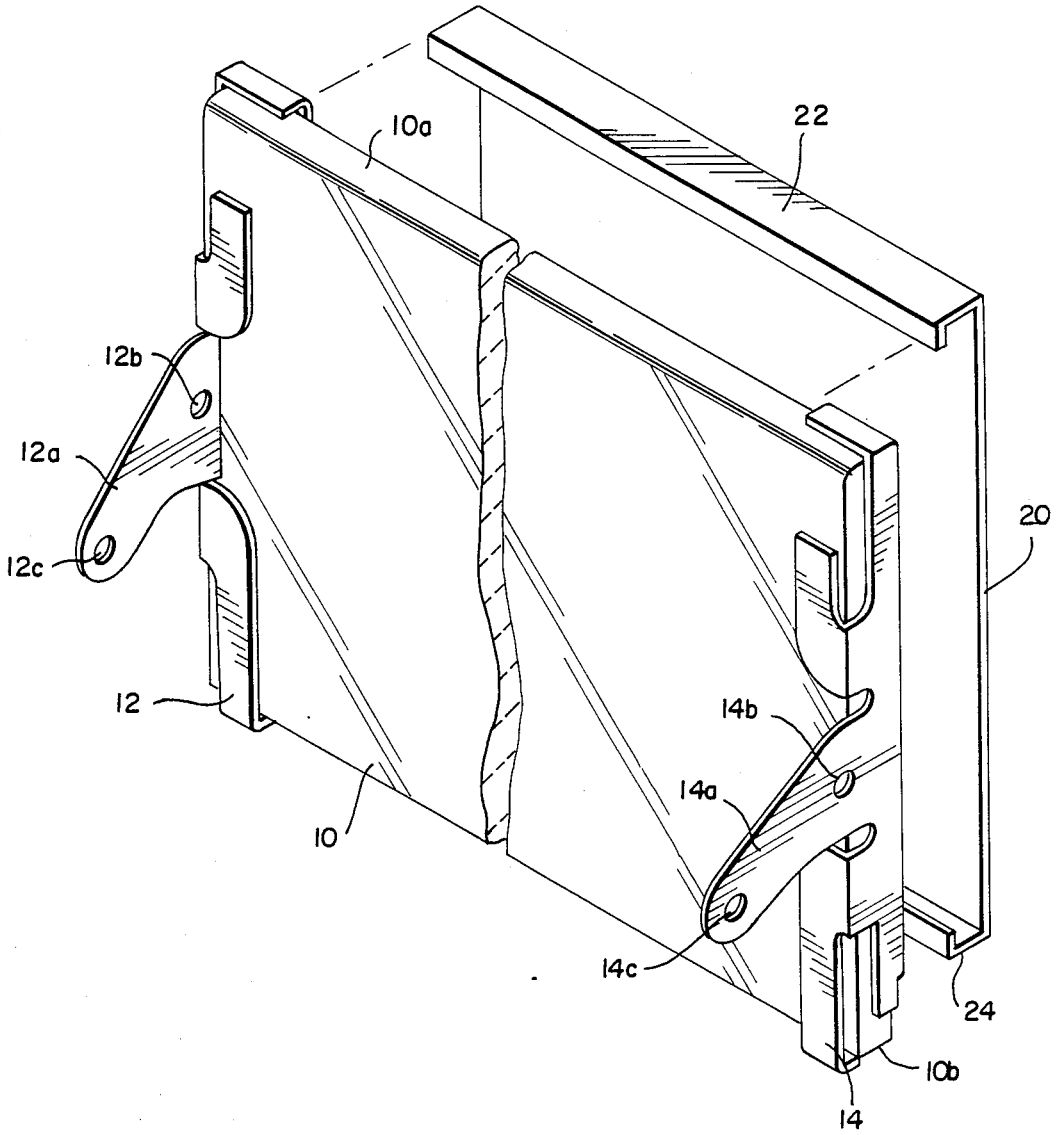
FIG. 1 is an exploded, perspective view showing a louver panel with the sun filter according to the invention.
Figure 2:
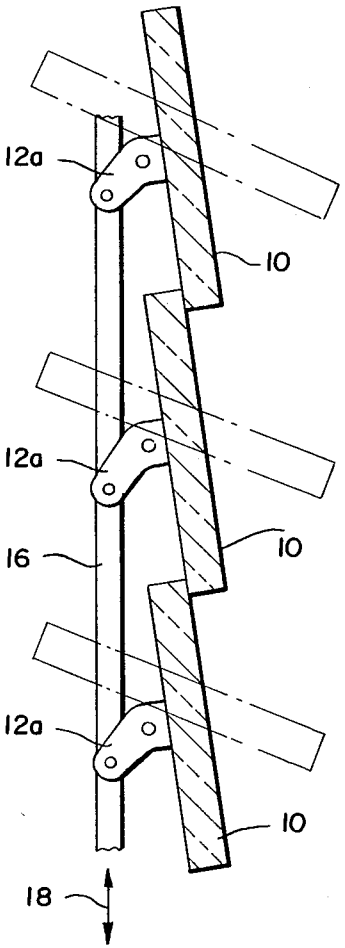
FIG. 2 is a partial, cross-sectional view showing the operation of a jalousie window incorporating a plurality of louver panels.

A typical louver panel, illustrated in FIG. 1, comprises a glass panel member 10 having on either end mounting brackets 12 and 14. The construction of brackets 12 and 14 and their attachment to panel member 10 are well known in the art. Each bracket has a mounting arm 12*a* and 14*a* defining pivot support holes 12*b* and 14*b*, as well as actuating arm holes 12*c* and 14*c*. Pivot holes 12*b* and 14*b* are coaxially aligned and facilitate the pivoting attachment of each louver panel to a window frame (not shown) in known fashion. Arms 12*a* and 14*a* extend from the plane of the glass louver panel 10. As illustrated in FIG. 2, a plurality of the louver panels 10 are attached to the window frame (not shown) such that their lower edges overlap upper edges of the adjacent louver panels. Each of the actuating arms 12*a* and 14*a* are interconnected by an actuating rod 16. As the actuating rod 16 is moved upwardly or downwardly in the direction of arrows 18 in FIG. 2, the louver panels 10 are pivoted between their closed positions indicated in solid lines in FIG. 2, and their open positions indicated by the dashed lines in FIG. 2. The structure for pivotally attaching each of the louver panels to the window frame as well as means for moving the actuating rod 16 are well known in the art and, per se, form no part of the present invention. Suffice to say that any of the known methods may be utilized in accordance with the present invention.

Figure 4:
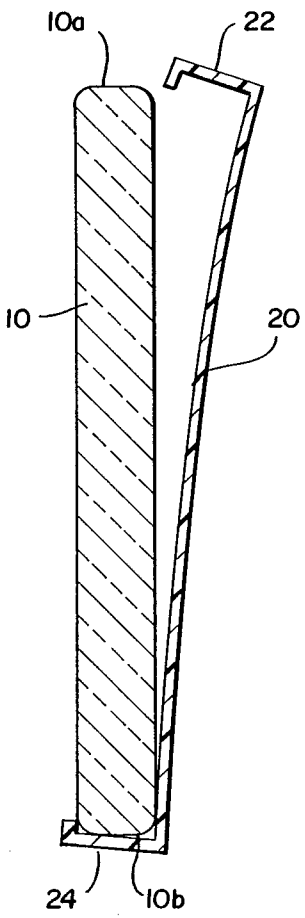
FIG. 4 is a cross-sectional view showing the installation of the sun filter of FIG. 3.
Figure 3:
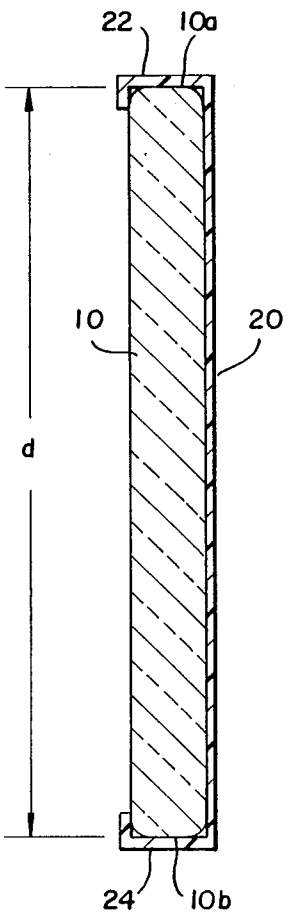
FIG. 3 is a cross-sectional view of the louvre panel in FIG. 1 incorporating a sun filter according to the present invention.

A first embodiment of the sun filter according to the present invention is shown in FIGS. 1, 3 and 4, and comprises a generally planar, non-opaque resilient filter panel 20 having frictional attaching legs 22 and 24 extending therefrom. The sun filter may be extruded or otherwise formed from a resilient, plastic material which may either be transparent or translucent (clear or tinted various colors). It is envisioned that the sun filter will have a thickness of approximately 0.007 inches although this will, quite obviously, vary according to the precise material and the size of the louver panel to which the sun filter is to be attached. The dimension d measured between the inner surfaces of the attaching legs 22 and 24 is approximately equal to the vertical dimension of the louver panel such that the legs 22 and 24 frictionally engage the edges 10*a* and 10*b* of the louver panel.

As best seen in FIG. 4, the sun filter 20 is applied to the louver panel 10 by bringing one of the attaching legs 22 or 24 into contact with the respective edge 10*a* or 10*b* of the louver panel and deflecting the opposite end of sun filter 20 as shown, such that the opposite attaching leg clears the opposite edge of the louver panel. The resilient nature of the filter panel 20 enables the sun filter to be "snapped" over the louver panel 10, such that the attaching legs 22 and 24 will frictionally engage in the opposite edges of the louver panel and hold it in place. Attaching legs 22 and 24 may also be resiliently deformed during installation of the filter.

Figure 5:
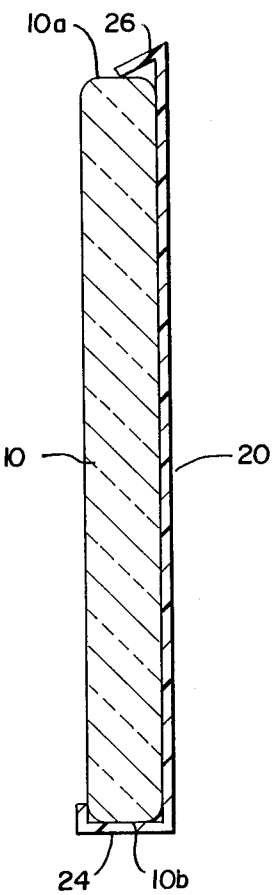
FIG. 5 is a cross-sectional view of a louver panel incorporating a second embodiment of the sun filter according to the present invention.

FIG. 5 illustrates a second embodiment of a sun filter according to the invention wherein the filter panel 20 and the frictionally attaching leg 24 are the same as those in the previously described embodiment. However, the upper attaching leg 22 has been replaced by an angled frictional attaching leg 26 which defines an acute angle with the filter panel 20. The dimension between the interior surface of attaching leg 24 and the extremity of attaching leg 26 measured substantially parallel to the filter panel 20 is approximately equal to the vertical dimension of the louver panel 10 to ensure that the legs frictionally engage opposite edges 10*a* and 10*b*, respectively.

Figure 6:
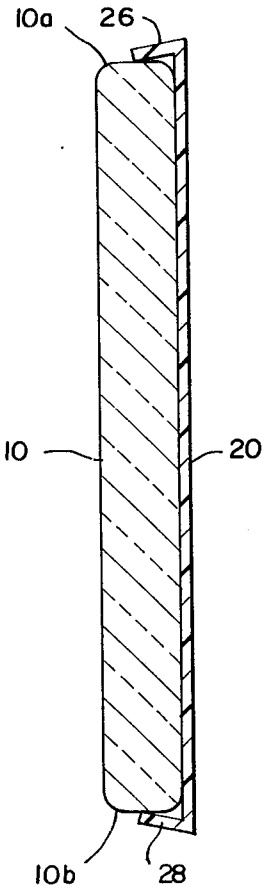
FIG. 6 is a cross-sectional view of a louver panel incorporating a third embodiment of a sun filter according to the present invention.

Another alternative embodiment is shown in FIG. 6 and is similar to that shown in FIG. 5, except that lower friction attachment arm 24 has also been replaced by angled friction attaching arm 28 which forms an acute angle with the filter panel 20. Again, the dimension between the extremities of attaching arms 26 and 28 is approximately equal to the vertical dimension of the louver panel 10 to ensure that the legs frictionally engage the opposite edges of the louver panel.

Figure 7:
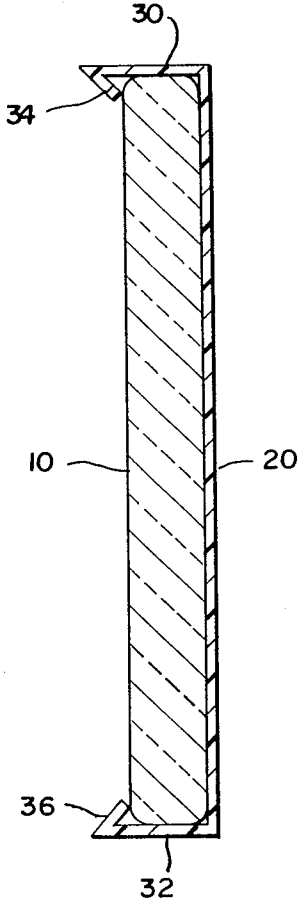
FIG. 7 is a cross-sectional view of a louver panel incorporating a fourth embodoiment of the sun filter according to the present invention.

FIG. 7 illustrates another alternative embodiment in which the frictional attaching arms 30 and 32 each comprise a portion extending generally perpendicularly to the filter panel 20 and each has end portions 34 and 36 forming an acute angle with the perpendicularly extending portions.

The installation of the alternative embodiments of the filter panel is substantially the same as that previously described and illustrated in FIG. 4. Namely, one of the attaching legs is brought into contact with the corresponding edge of the louver panel and the filter panel 20 is resiliently deformed so as to enable the opposite attaching leg to "snap" against the opposite edge of the louver panel. This enables all of the embodiments of the sun filter to be "snap" fitted over the louver panel such that they may be easily attached and removed without removing the louver panel from its supporting structure or interfering with its normal operation.

Although the sun filter is illustrated in the figures as being applied to the outside of the louver panels, it is to be understood that it may also be applied to the inside of the panels such that the resilient filter panel 20 is adjacent to the interior surface of the respective louver panel.

The foregoing description is provided for illustrative purposes only and should not be construed as in any way limiting this invention, the scope of which is defined solely by the appended claims.

I claim:

1. A sun filter to alter the light transmitting characteristics of a transparent louver panel having opposite edges separated by a distance d comprising:

(a) a non-opaque, resilient filter panel defining first and second edges; and, (b) first and second frictional attachment legs extending from the first and second edges of the panel with the closest portions of the legs being separated a distance less than d such that the legs snap over and frictionally contact the opposite edges of the louver panel to removably attach the sun filter to the louver panel.

2. The sun filter according to claim 1 wherein the first and second friction attaching legs are resilient.

3. The sun filter according to claim 1 wherein at least one of the first and second friction attaching legs defines an acute angle with the filter panel.

4. The sun filter according to claim 1 wherein both the first and second friction attaching legs define acute angles with the filter panel.

5. The sun filter according to claim 1 wherein the filter panel is formed so as to filter out ultraviolet rays.

6. The sun filter according to claim 1 wherein the filter panel is translucent.

7. The sun filter according to claim 1 wherein the filter panel is color tinted.

8. The sun filter according to claim 1 wherein the first friction attaching leg comprises:

(a) a first leg portion extending substantially perpendicular to the filter panel and defining a first distal edge; and, (b) a second leg portion extending from the first distal edge of the first leg portion.

9. The sun filter according to claim 8 wherein the second leg portion of the first friction attaching leg extends substantially parallel to the filter panel.

10. The sun filter according to claim 8 wherein the second leg portion of the first friction attaching leg defines an acute angle with the first leg portion.

11. The sun filter according to claim 8 wherein the second friction attaching leg comprises:

(a) a first leg portion extending substantially perpendicular to the filter panel and defining a second distal edge; and, (b) a second leg portion extending from the second distal edge of the first leg portion of the second friction attaching leg.

12. The sun filter according to claim 11 wherein the second leg portions of the first and second friction attaching legs extend substantially parallel to the filter panel.

13. The sun filter according to claim 11 wherein the second leg portions of the first and second friction attaching legs define acute angles with respect to the adjacent first leg portions.

14. A louver panel assembly comprising:

(a) a transparent, generally planar, rigid louver panel structurally supported at either end and having opposite edges separated a distance d; and, (b) a sun filter removably attached to the louver panel to alter the light transmitting characteristics of the louver panel, comprising:

(i) a non-opaque, resilient filter panel defining first and second edges; and, (ii) first and second frictional attachment legs extending from the first and second edges of the panel with the closest portions of the legs being separated a distance less than d such that the legs snap over and frictionally contact the opposite edges of the louver panel.

15. The louver panel assembly according to claim 14 further comprising bracket means attached to either end of the louver panel to structurally support the panel.

* * * * *